US008365451B2

(12) United States Patent
Seidl

(10) Patent No.: US 8,365,451 B2
(45) Date of Patent: Feb. 5, 2013

(54) MULTI-LAYER LABEL FOR AFFIXING TO A CURVED SURFACE, PARTICULARLY TO A CYLINDRICAL SURFACE, OF AN OBJECT

(75) Inventor: Peter Seidl, Munich (DE)

(73) Assignee: Schreiner Group GmbH & Co. KG, Oberschleissheim (DE)

( * ) Notice: Subject to any disclaimer, the term of this patent is extended or adjusted under 35 U.S.C. 154(b) by 246 days.

(21) Appl. No.: 12/803,341

(22) Filed: Jun. 24, 2010

(65) Prior Publication Data

US 2010/0326866 A1 Dec. 30, 2010

(30) Foreign Application Priority Data

Jun. 26, 2009 (DE) ..... 10 2009 030 841

(51) Int. Cl.
*G09F 3/10* (2006.01)

(52) U.S. Cl. ..... 40/638; 40/310; 283/81

(58) Field of Classification Search ..... 40/638, 40/306, 310; 283/81, 900
See application file for complete search history.

(56) References Cited

U.S. PATENT DOCUMENTS

| | | | | |
|---|---|---|---|---|
| 4,312,523 | A | 1/1982 | Haines | |
| 4,446,183 | A | 5/1984 | Savagian | |
| 4,921,277 | A | 5/1990 | McDonough | |
| 5,048,870 | A | 9/1991 | Mangini et al. | |
| 5,472,756 | A | 12/1995 | Sechet | |
| 5,829,789 | A | 11/1998 | Treleaven et al. | |
| 5,881,597 | A * | 3/1999 | Brooks | 73/428 |
| 6,193,279 | B1 | 2/2001 | Seidl | |
| 2004/0041392 | A1* | 3/2004 | Seidl | 283/81 |
| 2004/0071917 | A1 | 4/2004 | Unglert | |
| 2004/0244242 | A1* | 12/2004 | Maliner et al. | 40/310 |
| 2006/0000913 | A1 | 1/2006 | O'Rell et al. | |
| 2006/0107563 | A1 | 5/2006 | Farmsworth et al. | |
| 2008/0150275 | A1* | 6/2008 | Raistrick | 283/81 |
| 2008/0303265 | A1* | 12/2008 | Kaufman | 283/81 |
| 2010/0215876 | A1* | 8/2010 | Seidl | 428/34.1 |

FOREIGN PATENT DOCUMENTS

| | | |
|---|---|---|
| DE | 693 09 233 | 10/1997 |
| DE | 197 46 011 | 1/1999 |
| DE | 102 39 510 | 3/2004 |
| DE | 203 08 796 | 10/2004 |
| DE | 10 2004 043 301 | 3/2006 |
| EP | 1 276 089 | 1/2003 |
| EP | 1 394 600 | 3/2004 |
| WO | WO 99/21156 | 4/1999 |

* cited by examiner

*Primary Examiner* — Tashiana Adams
*Assistant Examiner* — Kristina Junge
(74) *Attorney, Agent, or Firm* — Collard & Roe, P.C.

(57) ABSTRACT

A multi-layer label (1) for affixing to a curved surface, particularly to a cylindrical surface, of an object has at least the following: a support foil (2) and at least one spare label (20; 20*a*, 20*b*, 20*c*), which is affixed to the support foil (2) in such a way that it is removable from the support foil (2), wherein the at least one spare label (20), in at least a first partial area (21) of its total area (25), is connected to the support foil (2), whereas at least a second partial area (22) of the total area (25) of the at least one spare label (20), which second partial area (22) includes a first edge (24) of the spare label (20), is free from any fixed connection to the support foil (2).

14 Claims, 4 Drawing Sheets

MULTI-LAYER LABEL FOR AFFIXING TO A CURVED SURFACE, PARTICULARLY TO A CYLINDRICAL SURFACE, OF AN OBJECT

CROSS REFERENCE TO RELATED APPLICATIONS

Applicant claims priority under 35 U.S.C. §119 of German Application No. 10 2009 030 841.5 filed on Jun. 26, 2009.

BACKGROUND OF THE INVENTION

1. Field of the Invention

The application relates to a multi-layer label for affixing to a curved surface, particularly to a cylindrical surface, of an object, for example of a packaging compartment for day-to-day life demands or of a container designed for specialist uses. Cylindrical objects, especially circular-cylindrical objects, often have a label affixed to them. For this purpose, also labels are required that are composed of several layers and have a removable part which has to be subsequently separated from the overall label applied to the object and has to be affixed to another object.

In the pharmacy sector, for example, vials are used in which a liquid medicament or the like is stored, particularly for medicaments that are to be administered using syringes. For this purpose, it is not only the vial or ampoule that is to be provided with a label, but also the syringe to be used for the injection. In hospitals, particularly in emergency wards and intensive care units, mixing-up of the doses of medication to be given to specific patients must be avoided under all circumstances. This requires an identification of the ampoule and also of the injection syringes, specifically directly after the respective syringe has been filled. For this reason, the multi-layer label and the removable label part contain relevant information, for example the name of the active substance or the trade name of the medicament, the dose or concentration of the medicament, the manufacturer, the use-by date, etc. For subsequent identification of the filled syringe, at least some of this information is provided on the removable label part that is to be applied to the syringe. The label transferred to the syringe is subsequently placed in the hospital records.

Such safety measures are used not only for medicament packages intended for a single administration, but also for those intended for multiple administrations. In the latter case, the date and time of administration, the amount administered or the name of the physician or medical assistant also have to be recorded on the transferred label part. In emergency wards and intensive care units, manual procedures of this kind are carried out under pressure of time and performance. Moreover, medical personnel generally wear gloves, which makes it difficult to detach individual and generally small label parts. However, in other areas of use without time constraints or other treatment-related factors, it is also desirable to be able to separate a part of a label more easily and more quickly, in particular when wearing gloves.

2. The Prior Art

WO 99/21156 and EP 1276089 B1 disclose multi-layer labels which are designed to be dispensed onto curved surfaces and which have a support foil and several spare labels. The spare labels extend in the axial direction beyond the support foil but follow the upwardly continued, partially cylindrical surface of the dispensed support foil. Nonetheless, the spare label adheres to the support foil over a large surface area.

SUMMARY OF THE INVENTION

The present application proposes a label which is designed to be dispensed onto a curved surface of an object and which, by virtue of its structure alone, permits easier and/or quicker detachment of a label part, especially in cases where gloves are being worn during the handling of the labelled objects.

This may be achieved by a multi-layer label for affixing to a curved surface, particularly to a cylindrical surface, of an object, said multi-layer label having at least the following:

a support foil and at least one spare label, which is affixed to the support foil in such a way that it is removable from the support foil, wherein the at least one spare label, in at least a first partial area of its total area, is connected to the support foil, whereas at least a second partial area of the total area of the at least one spare label, which second partial area comprises a first edge of the spare label, has no fixed connection to the support foil.

BRIEF DESCRIPTION OF THE DRAWINGS

Other objects and features of the invention will become apparent from the following detailed description considered in connection with the accompanying drawings. It is to be understood, however, that the drawings are designed as an illustration only and not as a definition of the limits of the invention.

In the drawings.

DETAILED DESCRIPTION OF PREFERRED EMBODIMENTS

Figure 1:
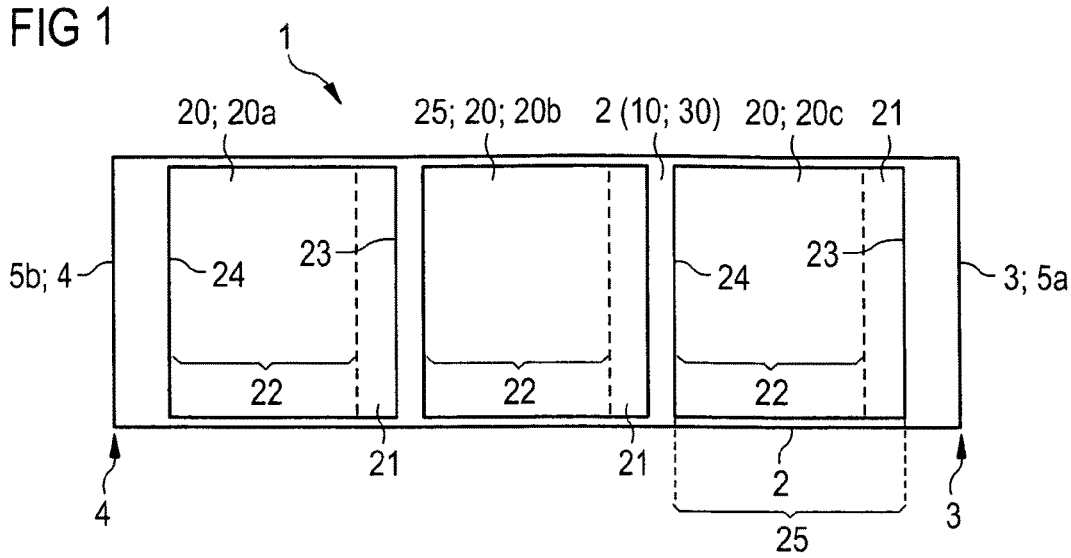
FIG. 1 shows a schematic plan view of an illustrative embodiment of a multi-layer label, which has a support foil and at least one spare label.

FIG. 1 shows a schematic plan view of an illustrative embodiment of a multi-layer label 1 according to the application with a support foil 2 and with at least one spare label 20. In FIG. 1, and in the subsequent figures, three spare labels 20*a*, 20*b*, 20*c* are shown in each case. However, any other desired number of spare labels, in particular also just one single spare label 20, can also be provided on the multi-layer label 1 according to the application. According to the schematic view in FIG. 1, the spare labels 20 can optionally be arranged above or below the support foil 2. The support foil 2 extends between its first edge 4 and its further edge 3, which edges are both arranged laterally outside the arrangement of spare labels 20. Both edges 3, 4 (first and second ends) are optionally designed as straight edges 5*a*, 5*b* which, during subsequent dispensing in the axial direction, come to lie on the curved surface of an object. As is indicated in FIG. 1, an adhesive film 25*a* is located only in a smaller, first partial area 21 of the total area 25 of the respective spare label 20 (see FIGS. 4 to 7 and 10) and produces the detachable adhesive connection to the support foil 2. By contrast, however, the larger, second partial area 22, which also comprises the surface centre of the respective spare label 20, is loose, i.e. without adhesive connection to the support foil. The at least one spare label 20 therefore tends to lift from the support foil 2 over a large surface area and straighten out as soon as the support foil 2 is bent according to the curvature of the object that is to be labelled. The support foil 2 can optionally be a lower foil 10 or an outer cover foil 30.

Figure 2:
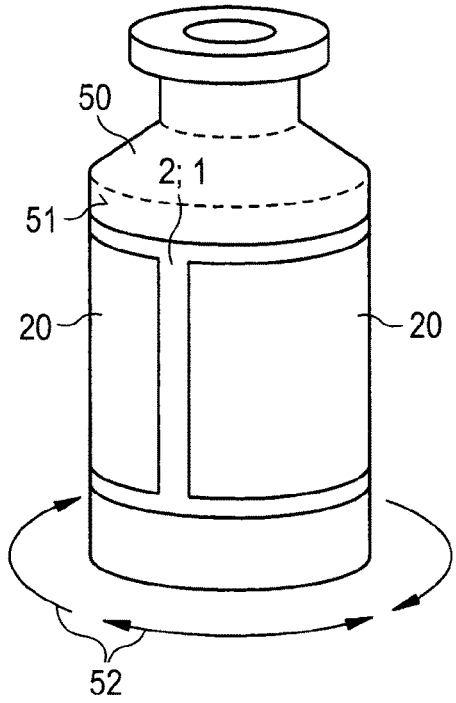
FIG. 2 shows a conventionally designed label which is affixed to a curved surface and which has a support foil and at least one spare label.

FIG. 2 shows an object 50 with a curved surface 51, in particular a cylindrical surface 51, about whose circumference 52 a conventionally designed multi-layer label 1 is affixed. Both the support foil 2 and the spare labels 20 follow the curvature of the surface 51. In the axial direction (vertically in FIG. 2), the surface 51 has a constant contour, at least in the area of surface contact with the label. The surface 51 can in particular have a circular symmetrical or elliptic shape or any other desired shape, but the outer circumference and the outer contour should not change in the axial direction in the area of the label. The illustrated object 50 can, for example, be an ampoule for a syringe liquid (a vial) or some other container for a liquid. The removal of the spare labels 20 from the support foil 2 on such small ampoules often causes problems, especially under pressure of time and when wearing gloves.

Figure 3:
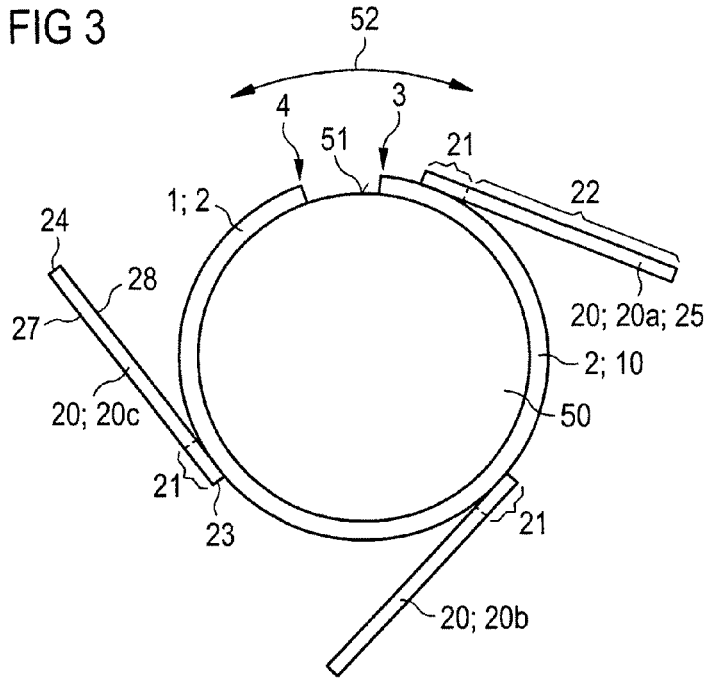
FIG. 3 shows an illustrative embodiment of a label according to the application after being dispensed to a curved surface, depicted in a schematic cross-sectional view from the axial direction.

FIG. 3 shows an illustrative embodiment of a multi-layer label 1 which has been wound around such an object 50 and in which, according to the application, only a small partial area 21 of each spare label 20 adheres to the support foil 2. Here, the spare labels 20*a* to 20*c* protrude from the support foil 2 over a large surface area and are therefore easy to grip and pull off, even when gloves are being worn. In particular, the spare labels tend to straighten out automatically and lift away from the support foil 2. By contrast, they conventionally lie on the support foil 2 over a large surface area and, in order to pull them off, they at best have quite small grip tabs, which can be gripped only with difficulty when the feeling at the finger tips is reduced or when gloves are being worn. The automatically protruding spare labels 20 shown in FIG. 3 permit rapid labelling of a syringe, filled with liquid from the object 50, or of any other object.

Figure 4:
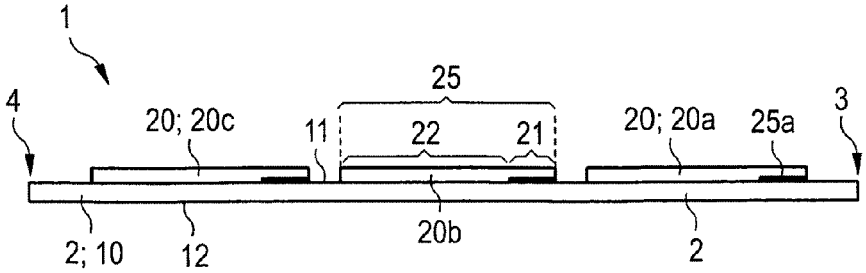
FIG. 4 shows a cross section of an illustrative embodiment of a label according to FIG. 1 or FIG. 3 before being dispensed.

FIG. 4 shows a schematic cross-sectional view of an illustrative embodiment for a multi-layer label. The illustrative embodiment corresponds, for example, to the one from FIG. 1 and/or FIG. 3. According to FIG. 4, the support foil 2 is arranged underneath the spare labels 20 and thus forms the lower foil 10. On the rear face 12, the lower foil 10 is provided with an adhesive film (not shown) over the entire surface area or over a large surface area. In this way, at least the lower foil 10 adheres to the curved surface 51 over the entire surface area, as is shown in FIG. 3. In each of the first partial areas 21 of the spare labels 20, an adhesive 25*a* is arranged which produces the adhesive connection to the lower foil 10. The other areas (the second partial areas 22) lift away from the lower foil 10 as the latter is bent.

The support foil 2 or the lower foil 10 can in particular be transparent, such that the rear faces 28 of the spare labels 20 can also be printed on subsequently by the user, for example with the aid of a long-wave laser. For this purpose, the spare labels 20 are formed, for example, from a laser foil whose reactive surface lies at the bottom. By contrast, the upper faces of the spare labels 20 are optionally already printed during production of the multi-layer label 1, optionally with provision for personalization by the user.

Figure 5:
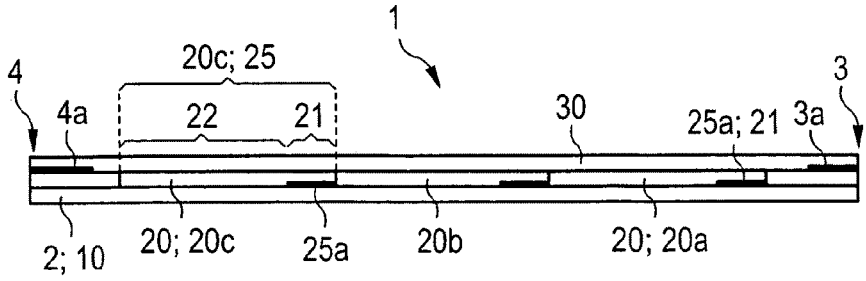
FIG. 5 shows an alternative illustrative embodiment to FIG. 4, with additional cover foil.

FIG. 5 shows a cross-sectional view of another embodiment of a multi-layer label in which, compared to FIG. 4, a cover foil 30 is additionally provided. The cover foil 30 is located above the spare labels 20 and is provided partially with adhesive films 3*a*, 4*a* only at its first end 33 and second end 34 (see FIG. 8). This ensures the adherence of the outer cover foil 30 on the first and second ends 3, 4 of the multi-layer label 1. By contrast, in the area above the total areas 25 of the spare labels 20; 20*a*, 20*b*, 20*c*, the underside of the cover foil 30 is non-adhesive and therefore only lies loosely. The spare labels 20 and also the cover foil 30 can be provided, for example printed, with information. However, after the upper face of the spare labels 20 has been printed, these are no longer accessible once the cover foil 30 is arranged over them. However, the lower foil 10, if it is transparent, also permits subsequent printing with the aid of a laser.

As can be seen from the films of adhesive 25*a* on the underside of the spare labels 20 in FIG. 5, the labels 20, in the first partial areas 21 of their total area, adhere to the lower foil 10, which thus serves as support foil 2 for the spare labels. During the dispensing of the multi-layer label 1 according to FIG. 5, the cover foil 30 first forms an outer envelope of the spare labels 20, which therefore cannot lift away from the lower foil 10 immediately after dispensing. However, as soon as the outer cover foil 30 is detached at one end (for example at the left-hand end by removal from the adhesive film 4*a*), the individual spare labels 20*a*, 20*b*, 20*c* and also the cover foil 30 lift away from the support foil 2; the spare labels 20 are now easy to grip and pull off.

Figure 6:
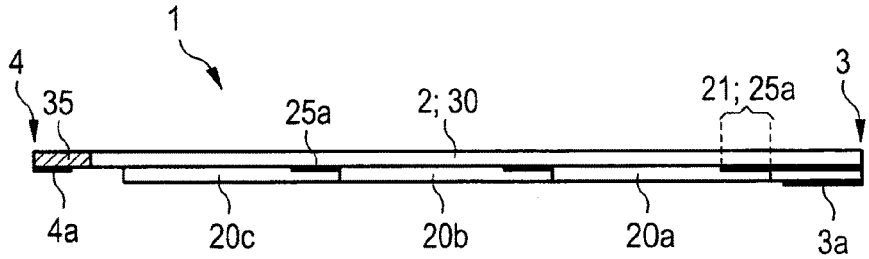
FIG. 6 shows another alternative illustrative embodiment with a support foil arranged above the spare labels.

FIG. 6 shows another alternative embodiment in which the outer cover foil 30 forms the support foil 2 for the spare labels 20. Accordingly, the adhesive 25*a* of the spare labels 20 is now arranged on the front face or upper face thereof, as a result of which the spare labels 20 now adhere to the outer cover foil 30 (but only within the first partial area 21 of the respective total area). In the lateral direction, that is to say on both sides in the circumferential direction, the cover foil 30 extends in opposite directions beyond the at least one spare label 20, as can be seen from the first and second ends 3, 4 of the label. The adhesive film 4*a* here has the purpose of (detachably) securing the cover foil, at least at one end, directly to the curved surface of the object. In this embodiment, the undersides of the spare labels can also subsequently be printed with coloured ink.

Figure 7:
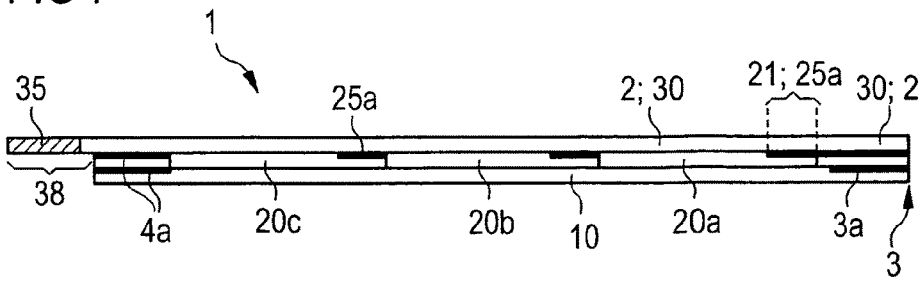
FIG. 7 shows yet another alternative illustrative embodiment in connection with FIG. 6, but with a lower foil additionally provided under the spare labels.

FIG. 7 shows another illustrative embodiment in which, compared to FIG. 6, a lower foil 10 is additionally arranged under the spare labels 20 and the cover foil 30. In this case, however, it is not the lower foil 10 but (as in FIG. 6) the cover foil 30 that serves as support foil 2. At least at one end, the cover foil 30 optionally extends beyond the lower foil 10, as can be seen on the left-hand side of FIG. 7 (protruding end 38). There, a grip tab 35 can additionally be provided, which can extend in the axial direction of the labelled object to a point beyond the narrowing at the neck of the ampoule (FIG. 2). By contrast, in this embodiment too, the spare labels 20*a* to 20*c* do not have any grip tabs. In this embodiment, the entire cover foil 30 (together with the spare labels 20) lifts away automatically, and over the entire surface area, from the (curved) lower foil 10 as soon as the cover foil is detached at one end. Thereafter, it is easily bendable, such that the spare labels can also be pulled off more easily than from the rigid surface of the object.

In this illustrative embodiment too, the lower foil 10 can be transparent. Moreover, as in FIGS. 4 and 5, it is also provided with an adhesive film (not shown) over the whole or at least over a large area of its underside. Located below it, before dispensing, there is a siliconized surface or otherwise adhesion-reduced surface of a support, for example of a web-shaped underlay necessary for packaging.

Figure 8:
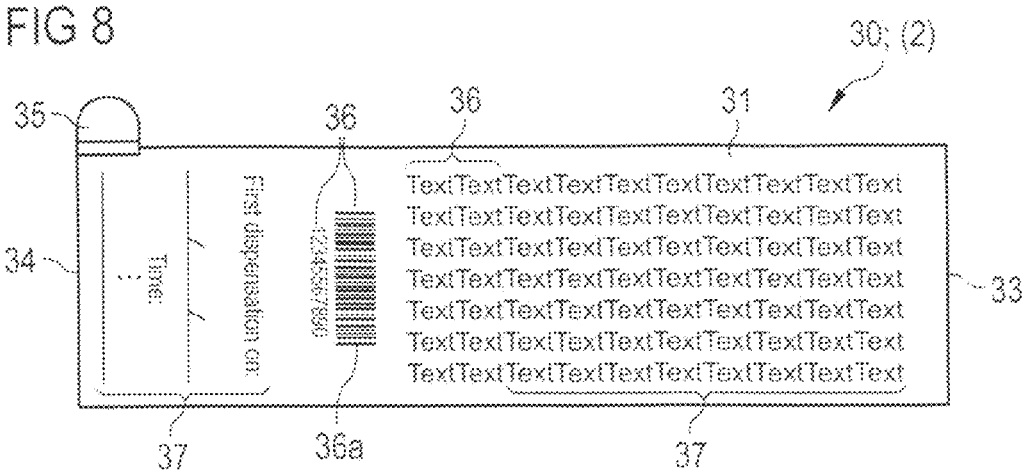
FIG. 8 shows a schematic plan view of an illustrative embodiment of the design of a cover foil, provided thus far in the other illustrative embodiments and designs in this application.

FIG. 8 shows a schematic plan view of a cover foil 30 which can be provided in conjunction with the other illustrative embodiments and designs in this application. The figure depicts the front face 31 of the cover foil 30, which front face 31 is directed outwards on the dispensed multi-layer label 1. The length of the cover foil 30 between its first end 33 and its second end 34 is chosen such that extends in both directions beyond the spare labels and, if a lower foil is present, also completely covers said lower foil. The cover foil 30 can extend completely or only partially (as shown in FIG. 3) around the object 50 to be labelled.

First information items 36 and second information items 37 are provided on the cover foil 30. The first information items 36 are optionally ones that are found identically, or at least with the same content, also on the at least one spare label 20, as will be described below with reference to FIGS. 9 and 10. The first information items 36 can in particular be personalization data, for example a barcode 36*a*, or other alphanumeric signs. A printable field 37 can also be provided on which the user has to record the nature, time or amount of the removal or use. Unlike the automatically straightening spare labels 20, the cover foil 30 can be provided with a grip tab 35 in order to permit the automatic straightening out of the spare labels 20 not during the dispensing of the label 1 but only at a later time. If the spare labels 20 are affixed to the rear face of the cover foil 30, the cover foil 30 serves at the same time as support foil 2.

Figure 9:
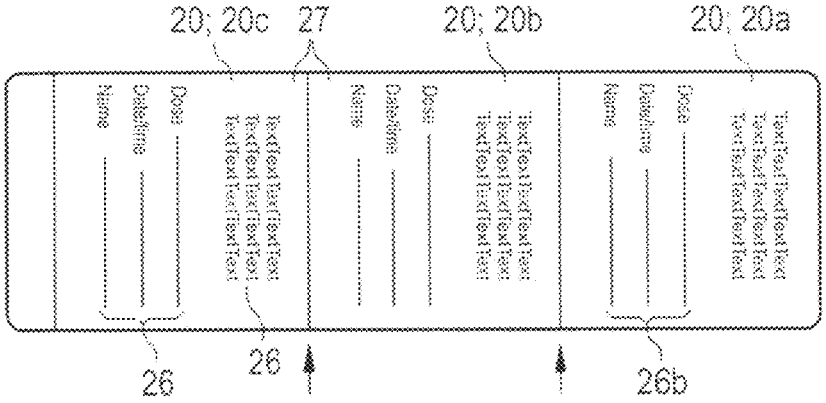
FIG. 9 shows a plan view of the front face of several spare labels according to one illustrative embodiment.

FIG. 9 shows an illustrative embodiment of the design of the at least one spare label. A film layer is depicted containing three spare labels 20*a*, 20*b*, 20*c*, which are each separated from one another by cut lines (indicated by arrows in FIG. 9). The side of the spare labels 20 shown in plan view in FIG. 9 is, for example, the front face thereof. The spare labels 20 are provided with first information items 26, which are optionally identical for all spare labels. The first information items 26 optionally contain (like the first information items 36 of the cover foil 30 in FIG. 8) alphanumeric data and/or a printable field 26*b* and/or a barcode.

Figure 10:
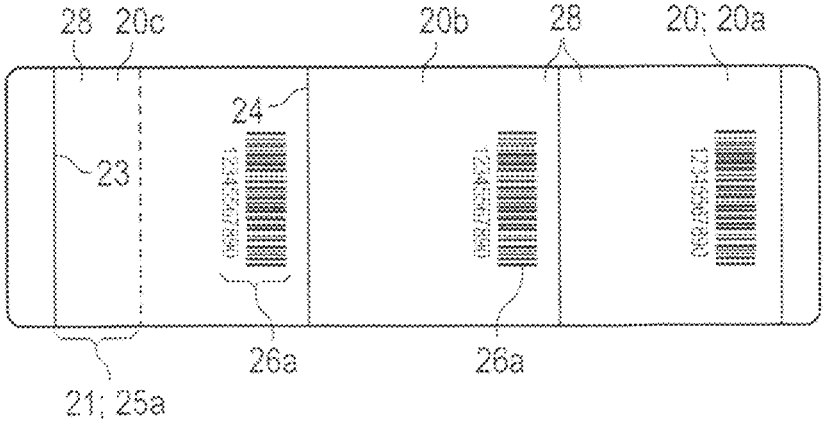
FIG. 10 shows a schematic plan view of the rear face of several spare labels according to one illustrative embodiment.

FIG. 10 shows the opposite surface of the spare labels 20 from FIG. 9, for example the rear face thereof. As can be seen from FIGS. 9 and 10, the first information items 26 can be shared between the front face and the rear face. For example, a barcode 26*a* or some other alphanumeric personalization data are arranged here on the rear face 28 (FIG. 10) of the spare labels 20, whereas further first information items 26 are arranged on the front face 27 (FIG. 9). In this way, the data on the rear face, for example the barcode 26*a*, can be applied subsequently by the user, specifically even when the printed front faces 27 of the spare labels 20 are covered, for production reasons, with the cover foil 30, that is to say are no longer accessible. If a transparent lower foil 10, or a film 10 provided with a transparent window, is arranged underneath the spare labels 20 (see FIGS. 5 and 7), the barcode 26*a* can be generated with the aid of a laser beam through the lower foil 10. The same applies conversely for the subsequent printing of the spare labels 20 from outside, which can be done, for example, through a transparent outer cover foil 30, or through an outer cover foil 30 provided with a transparent window or with a recess. The designs and illustrative embodiments set forth in the figures and in other parts of the application are given only by way of example and can be present in any desired combinations with one another.

The application proceeds from a multi-layer label which has at least one support foil and at least one spare label affixed on or under the support foil. The multi-layer label here is not to be confused with the customary arrangement of a multiplicity of labels on a common support, because in the present case the support foil itself forms a constituent part of the multi-layer label, i.e. it is also dispensed itself and, on its rear face for example, serves as an adhesive surface.

According to the application, each spare label adheres only in a smaller partial area of its total area to the support foil and is affixed detachably thereto. In the second partial area, by contrast, the at least one spare label is loose and has no such adhesive or partially adhesive connection to the support foil. This has the effect that, depending on the curvature of the overall label, most of the spare label lifts off from the support foil, i.e. forms a protruding tab. In doing so, the stiffness alone of the spare label has the effect that the latter automatically straightens out over (that is lifts off) the surface of the support foil, without external action by the user.

In the multi-layer label according to the application, this intended effect according to the application does not necessarily already occur in the state ready for dispensing, but, depending on the embodiment, may occur only after the multi-layer label has been dispensed on an object with a curved surface, or only after additional preparation on the already labelled object. However, use is made of the fact that, after being dispensed, the multi-layer label and its support foil adopt the same curvature of the labelled surface of the object. Traditionally, by contrast, an adhesive film covering the entire surface area or a large surface area is provided under the "daughter label" in an attempt to ensure that the latter adheres reliably to the curved support foil.

Here an approach is proposed in which the at least one spare label may rise from the support foil, specifically over a large surface area and without external action. Although a self-straightening, protruding tab of this kind might traditionally be felt to interfere with the handling of the labelled product, particularly when two or more of them are present on the overall multi-layer label. However, at least when it comes to rapid and easy detachment of the spare label (even when gloves are being worn), the label according to the application facilitates the rapid separation of spare label and overall label.

According to the application, a substantial part of the total area of the spare label, which part comprises a first edge of the spare label, has no adhesive, partially adhesive or other kind of adhesive connection to the support foil. While a first part of the total area of the spare label does have such an adhesive connection to the support foil, the substantial second part of the total area of the spare label lies only loosely on the support foil and later straightens out independently. Provision is made that the second partial area of the total area of the at least one spare label starts from a (first) lateral edge or edge area, i.e. a (optionally straight) edge of the spare label. At this first edge, the at least one spare label straightens out above the support foil. By contrast, at a further edge or edge area, optionally an opposite edge or edge area, the spare label is affixed detachably to the support foil. The first area, which starts from the first edge, can extend to the surface centre of the spare label or also beyond this. Thus, according to the application, each spare label lifts away from the support foil over a large surface area.

Depending on the design, the spare label, or the whole support foil together with spare label, can protrude from the curved surface. In particular, the support foil can be provided underneath the spare label or (as outer cover foil) also above the spare label. In both cases, there is no fixed connection to the support foil in the second area of the total area of the spare label. Instead, the at least one spare label straightens out independently as soon as this is allowed by the dispensing on the object or at the latest by a subsequent preparation.

Provision is optionally made that the first edge, which forms part of the second partial area of the at least one spare label, limits the spare label to one unwinding direction provided for affixing the multi-layer label. Since the multi-layer label is intended to be affixed to a curved surface, particularly a cylindrical surface, an unwinding direction is also predefined by the structure of the multi-layer label. This is the direction in which the label is unwound when being dispensed on the object, i.e. the direction in which the surface proportion of the label already affixed during the dispensing increases. During dispensing on an object with a vertical axis of symmetry for example, the label is affixed horizontally around the object. In doing so, the left-hand end of the label comes to lie first on the curved surface of the object, the right-hand end of the label last, or vice versa. Likewise, the respective spare labels come to lie only one after another on the object. Accordingly, the unwinding direction is to the left or right, such that the first edge of the spare labels is also arranged to the left or right and in particular points to the next adjacent spare label.

Provision is optionally made that the first partial area of the total area of the at least one spare label, starting from a further edge of the at least one spare label opposite the first edge, extends across a width of at least 2 mm. The adhesive film, by which the spare label adheres to the support foil, is thus arranged at the opposite edge. In accordance with the minimum width of the adhesive area of only two millimeters, the spare label can straighten out from the support foil over a large surface area, almost the whole surface area, whereas only a small edge area with a width of at least 2 mm adheres to the support foil.

By this means, and by virtue of the circumstance that the spare label, when dispensed on curved surfaces, straightens out from the support foil automatically and over a large surface area, there is no longer any need for grip tabs, which are traditionally required in order to permit or to facilitate removal of spare labels from the support foil.

The outline of the total area of the spare label has a rectangular shape (corresponding to a rectangular printable field) or is at any rate adapted (irrespective of any rounded corners) to a rectangular basic shape.

A plurality of spare labels are optionally provided, optionally in a single foil layer. Each spare label represents a "daughter label" of the overall multi-layer label and, when necessary, is detached from the labelled object and affixed to another object. Particularly in the dosing of medicaments that are to be administered for example from multi-dose packs, for example vials or other containers, the repeated removal of a respective spare label can be expedient. The spare labels of the same foil layer can be arranged directly adjoining one another or spaced apart from one another.

All of the spare labels, optionally at the same edge of their total area, for example at the left-hand edge, are loose, i.e. without adhesive connection to the support foil, such that all of the spare labels protrude in the same circumferential direction above the periphery of the labelled object.

In the first area of the total area, for instance near the first edge (for example the left-hand edge), all the spare labels are free of adhesive or made non-adhesive. For this purpose, the first surface area of the spare label can also be provided with a neutralized layer whose original adhesive action is cancelled. At a further edge, optionally an opposite edge, the spare label has an adhesive, which adheres more strongly to the spare label than to the support foil. For this purpose, for example, the support layer is siliconized.

The support foil has a first end and a second end, by which means the support foil is limited at both ends in the circumferential direction. Between these ends, the support foil is non-adhesive, for example siliconized, at least on one side, so as to be able to apply the at least one spare label and detach it again. The support foil is optionally delimited by straight edges, of which some represent the two ends. The first edge and the further edge of the at least one spare label then extend parallel to the straight edges at the first end and second end of the support foil, even after application to the curved object. In particular, provision is made that the total area of the support foil completely overlaps the total areas of the at least one spare label and that the support foil protrudes laterally with its first and second ends beyond all the spare labels. Thus, the support foil extends at both ends, at least in the circumferential direction of the labelled object, beyond the spare label or spare labels.

The multi-layer label is optionally designed in such a way that it can be affixed as a whole in one unwinding process onto a curved surface, particularly a cylindrical surface, of an object, and the first and second ends of the support foil (or of a film lying under the latter) then come to lie one after another on the surface of the object. The multi-layer label is therefore designed in such away that it can be wound and affixed around a curved object. This requires a certain flexibility of the multi-layer label as a whole, but also a suitable arrangement or orientation of the cut edges of the one or more spare labels and also of the adhesive areas between spare label and support foil; the arrangement and orientation of these elements must be adapted according to the profile of the subsequent circumferential direction or the axial direction after dispensing on an object.

In particular, the multi-layer label is designed in such a way that it can be applied on a curved surface of an object in such a way that the at least one spare label, by virtue of its stiffness, protrudes from the curved surface. Particularly in the case of several spare labels on a multi-layer label, each spare label protrudes individually as a self-straightening tab. Likewise, the support foil as a whole, if it lies on the outside, can also protrude from the curved surface. In this case, it is easy to bend in order to detach one of the spare labels from it.

The multi-layer label is optionally designed in such a way that, after it has been affixed along a circumference of a curved surface of an object, each spare label protrudes with the second partial area of its total area in the circumferential direction from the curved surface of the object. If several spare labels are provided, all of them optionally protrude from the circumference of the object in the same direction. Even when the spare labels do not yet protrude directly after dispensing of the multi-layer "mother label", because of the support foil or a cover foil lying on the outside, the mother label can at least be prepared (for example by detachment of the outermost foil at one end) such that the spare labels and/or the support foil straighten out relative to the curved surface.

Optionally, at least two spare labels are arranged next to one another between the first end and the second end (the left-hand end and the right-hand end) of the support foil. Their total areas do not overlap, but at most directly adjoin one another. Support foil and spare labels are optionally made from plastic. This has advantages in medical applications for example; such foils are also more tear-resistant than paper films. In particular, the base material of the support foil and of the spare labels can be of plastic.

The support foil and the at least one spare label each optionally have only a single foil, in particular only a single plastic foil.

The at least one spare label is optionally printed with first information items. These information items are not only general information for identifying the product according to its type (for example the name of the product or medicament, the trade name, the manufacturer or supplier, etc.), but also specific information for personalization of the individual product package provided with the dispensed label. For example, the first information items can also contain serial numbers, expiry dates or batch numbers. The information items used for the personalization can in particular also comprise a barcode, by which the multi-layer label or even its individual spare label can be individualized. However, the first information items are optionally identical to each other at least on the spare labels. Moreover, the first information items on the spare labels can also contain further data which concern not only the characterization of the object that is to be labelled but also the subsequent use of said object. For medical use, for example, the first information items can contain an opening date or administration date, the name of the physician or of the medical assistant carrying out the administration, details of the time or nature of the administration to the patient, or also empty printable fields for said data. In this way, documentation steps relating to the treatment can be carried out on the removed spare labels.

The information items provided on the spare labels can be arranged on the front face and/or rear face of the respective spare label. For example, in the case of a spare label partially connected on the rear face to the support foil, the front face is easily accessible and printable.

However, additional provision of information on the rear face of the label may be desirable if the front face of all the spare labels is later covered by an outer cover foil that is intended to remain there until the labelled product is used. It may also be expedient for some of the first information items, particularly those for personalization of the individual label or product (for example a barcode), to be applied only subsequently, for example before the dispensing by the customer. If the rear face of the spare labels (after the detachment of the overall multi-layer label from its support) is exposed or remains visible through a transparent lower foil, a barcode or some other identification can also be applied subsequently to the rear face.

For this purpose, provision is optionally made that the plastic foil of the at least one spare label is a laser foil whose front face or rear face is changed in colour by the action of a laser. Such laser foils, which react to the action of a long-wave laser (mostly by a local change of colour and thus by visualization of the laser action), allow barcodes or other information items also to be applied from behind onto the rear faces of all the spare labels of the multi-layer "mother label". In this way, after opening the pack of labels, the user is able to individually print all or some of the labels, which, except from this, are already prepared for use. For example, the at least one spare label can already be printed on its front face and can be provided on its rear face with a laser-sensitive surface (or vice versa).

Provision is optionally made that the multi-layer label has a lower foil on whose front face the at least one spare label is arranged. The lower foil optionally has a rear face or lower face that is adhesive over its entire surface area, or at least over a large surface area, and that is used for affixing to an object that is to be labelled. The lower foil thus forms the constituent part of the affixable label and is in particular itself affixed to the object that is to be labelled. The lower foil can also be transparent.

In another embodiment, the multi-layer label comprises, instead of the lower foil, or in addition to the lower foil, an outer cover foil which is arranged on or above the at least one spare label. The rear face of the outer cover foil is optionally non-adhesive, at least in the area of the overlap with the total areas of the spare labels.

Such a cover foil offers a larger printable surface area for the overall product that is to be identified. Further or second information items can be provided on it (instead of the first information items or in addition to the latter) which do not need to be present on the spare labels or which are omitted from the latter for reasons of space. The outer cover foil has the further advantage that, during the transport of individual product packages, the self-straightening spare labels do not immediately get in the way by straightening out independently, and instead they are able to lift away from the rounded surface of the object only after partial detachment of the outer cover foil. The cover foil can at the same time serve on its inside as a support foil, such that a lower foil underneath the spare labels can be omitted. However, it can also be provided in addition, particularly for affixing over the entire surface area of the object.

If a lower foil is provided, the cover foil is secured at one end to a corresponding end of the lower foil, if appropriate via an intermediate layer to maintain the label thickness. At another, second end, the cover foil optionally extends laterally beyond the spare label or spare labels. It can have the same width as the lower foil, such that the lower foil, after the dispensing, serves to the right and left as a base for the cover foil. The adhesive force between the two is therefore predictable. Alternatively, however, the cover-foil can also extend at its second end beyond the lower foil, such that, after the dispensing, it adheres directly there to the surface of the object. This permits a reduced adherence to glass or another surface material.

The width of the label between the first and second ends, between which the label is unwound around the object during the dispensing, can be dimensioned such that the label covers part of the object or is affixed all the way round the object or more than all the way round.

Moreover, the cover foil can be permanently affixed at one end and is or can be affixed resealably at the other end. At the more easily detachable end, the cover foil can in particular have a grip tab, which is optionally arranged laterally outside of and also above or below the vertical extent of the spare labels. This ensures that accidental detachment of a spare label lying underneath is avoided as long as the outer cover foil is not removed at one end or removed completely.

All of the spare labels are optionally directed with their first edge (or left-hand edge) towards the same end of the cover foil. This has the advantage that, after the cover foil is opened, all the spare labels straighten out in the same circumferential direction about the periphery of the object.

According to one embodiment, the lower foil of the multi-layer label is the support foil, and the at least one spare label is arranged on the front face of the lower foil. The lower foil is thus a constituent part of the affixable label, i.e. the lower foil can itself be affixed to the object that is to be labelled. In addition, a cover foil can be provided above the spare label, such that all the spare labels are arranged between the support foil and the cover foil.

According to an alternative embodiment; a cover, foil of the multi-layer label can be the support foil, and the at least one spare label is arranged on the underside or rear face of the cover foil. In this case, the cover foil forms the main constituent part of the affixable label. The adherence of the overall label to the object can be effected with the aid of the two outer lateral ends of the cover foil. Alternatively, in addition to the cover foil and to the spare labels, a lower foil can be provided, such that all the spare labels are arranged between the lower foil and the support foil. Moreover, further layers or intermediate layers can be provided, and the abovementioned films and label sections can also each be in several parts or several layers and/or can be provided with additional coloured surface layers or other surface layers.

The at least one spare label is optionally designed such that it does not protrude laterally beyond the outer contour of the support foil. Although it can straighten out in a direction perpendicular to the surface of the support foil, the spare label is cut to size in such a way that it nowhere extends past the support foil in a direction parallel to the (possibly laterally continued) support foil surface. This fundamentally distinguishes the spare label from conventional grip tabs, which form a lateral overhang.

According to one development, the dimension of the total area of the support foil between its first end and its second end is such that the support foil, when dispensed, partially overlaps itself and, in an overlapping partial area, comes to lie on itself and/or on at least one spare label. The length of the support foil can, for example, amount to up to twice the circumference of the object around which it is to be affixed and for which the label is designed. In particular, the support foil, in the overlapping partial area, can cover one or more spare labels or indeed all of the spare labels.

The object provided with the label according to the application permits, better than conventionally labelled objects, quick and easy detachment of spare labels, specifically under difficult conditions (for example when gloves are being worn) and also in circumstances where safety paramount, for example in the medical field.

Although a number of illustrative embodiments of the present invention have been shown and described, it is to be understood that many changes and modifications may be made thereunto without departing from the spirit and scope of the invention.

The invention claimed is:

1. Multi-layer label (1) for affixing to a curved surface, particularly to a cylindrical surface, of an object, said multi-layer label (1) having at least the following:

a support foil (2) and a plurality of spare labels (20; 20*a*, 20*b*, 20*c*), all the spare labels being arranged next to one another in a single layer of foil;

each spare label (20) comprising a first partial area (21) of its total area (25), the first partial area of the respective spare label being affixed and connected to the support foil (2) in such a way that it is removable from the support foil (2), whereas a second partial area (22) of the total area (25) of the respective spare label (20) comprises a first edge (24) of the respective spare label (20), which first edge is free from any fixed connection to the support foil (2), wherein the first edge limits the respective spare label to one unwinding direction provided for affixing the multi-layer label, wherein the first partial area of the respective spare label is adjacent to a further edge opposite to the first edge, wherein the support foil extends between two edges, which two edges of the support foil are both arranged laterally outside the plurality of spare labels, and wherein the first edge of at least one spare label, in a state in which the second partial area of the at least one spare label lies loosely on the support foil, is facing the first partial area of another spare label.

2. Multi-layer label according to claim 1, wherein each spare label (20), at one edge (24) of its total area (25), can straighten out with respect to the support foil (2) and, at a further edge (23), is provided with an adhesive (25*a*), wherein the multi-layer label (1) is designed such that the adhesive (25*a*) adheres more strongly to the respective spare label (20) than to the support foil (2).

3. Multi-layer label according to claim 1, wherein the multi-layer label (1) can be arranged on a curved surface (51) of an object (50) such that each spare label (20; 20*a*, 20*b*, 20*c*), because of its stiffness, straightens out from the curved surface (51) of the object (50) and protrudes tangentially from the curved surface (51) of the object (50).

4. Multi-layer label according to claim 1, wherein each spare label (20) is printed with first information items (26), which first information items (26) are identical on all the spare labels (20; 20*a*, 20*b*, 20*c*) of the multi-layer label (1) and contain personalization data for personalizing the multi-layer label (1).

5. Multi-layer label according to claim 1, wherein each spare label (20) has a laser foil whose front face and/or rear face can be changed in color by the action of a laser.

6. Multi-layer label according to claim 1, wherein the multi-layer label (1) has a lower foil (10) on whose front face (11) each spare label (20) is arranged, and wherein the lower foil (10) has a rear face (12) which, for affixing to an object, is adhesive over its entire surface area or at least over a large surface area.

7. Multi-layer label according to claim 6, wherein the lower foil (10) of the multi-layer label (1) is the support foil (2), and wherein each spare label (20) is arranged on the front face (11) of the lower foil (10).

8. Multi-layer label according to claim 1, wherein the multi-layer label (1) has an outer cover foil (30) which is arranged on or above each spare label (20) and whose rear face (32), at least where the cover foil (30) overlaps the total area (25) of the spare label (20), is non-adhesive.

9. Multi-layer label according to claim 8, wherein the cover foil (30) is completely transparent or is transparent in some areas.

10. Multi-layer label according to claim 8, wherein the cover foil (30) is permanently affixed at a first end (33) and is or can be affixed resealably at an opposite second end (34).

11. Multi-layer label according to claim 8, wherein the cover foil (30) of the multi-layer label (1) is the support foil (2), and wherein each spare label (20) is arranged on the rear face (32) of the cover foil (30).

12. Multi-layer label according to claim 1, wherein the support foil (2) and each spare label (20) each comprise only a single film, optionally a plastic foil.

13. Multi-layer label according to claim 1, wherein the dimension of the total area of the support foil (2) between its first end (3) and its second end (4) is such that the support foil (2), when dispensed, partially overlaps itself and, in an overlapping partial area, comes to lie on itself and/or on each spare label (20).

14. Object (50) with a curved surface, particularly a cylindrical surface (51), wherein the object (50) is provided with a label (1) according to claim 1.

* * * * *